US005639173A

United States Patent [19]

Eng

[11] Patent Number: 5,639,173

[45] Date of Patent: Jun. 17, 1997

[54] LINKAGE SUPPORT SYSTEM

[75] Inventor: Norman Eng, Commack, N.Y.

[73] Assignee: Northrop Grumman Corporation, Los Angeles, Calif.

[21] Appl. No.: 626,891

[22] Filed: Apr. 3, 1996

[51] Int. Cl.[6] ..... H01Q 1/12; H01Q 1/28

[52] U.S. Cl. ..... 403/59; 403/53

[58] Field of Search ..... 343/765, 882, 343/890; 403/53, 57, 59, 52

[56] References Cited

U.S. PATENT DOCUMENTS

| | | | |
|---|---|---|---|
| 545,353 | 8/1895 | Fenner . | |
| 1,185,435 | 5/1916 | Powell | 403/53 X |
| 1,342,300 | 6/1920 | Sheler . | |
| 2,899,677 | 8/1959 | Rockall | 343/765 X |
| 3,263,447 | 8/1966 | Baker . | |
| 3,656,164 | 4/1972 | Rempt | 343/765 X |
| 4,118,952 | 10/1978 | Kobayashi . | |
| 4,197,548 | 4/1980 | Smith et al. | 343/765 |
| 4,558,325 | 12/1985 | Strom | 343/765 |
| 4,588,388 | 5/1986 | Chivari | 464/69 |
| 4,804,352 | 2/1989 | Schmidt | 464/17 |
| 5,186,686 | 2/1993 | Staples | 464/69 |

*Primary Examiner*—Anthony Knight
*Attorney, Agent, or Firm*—Terry J. Anderson; Karl J. Hoch, Jr.

[57] ABSTRACT

A linkage support system for interconnecting first and second structures in a manner which allows deformation of the first structure while mitigating the transmission of structural loads to the second structure has a spherical bearing for attaching a first portion of the first structure to a first portion of the second structure; and at least two link assemblies for attaching a second portion of the first structure to a second portion of the second structure. Each of the link assemblies has a link member extending generally from the first structure to the second structure, a pivot pin for attaching the link member to one of the first structure and the second structure, and a second spherical bearing for attaching the link member to the other of the first structure and the second structure. The first spherical bearing cooperates with the link assemblies to mitigate the transmission of structural loads to the second structure when the first structure is deformed.

14 Claims, 10 Drawing Sheets

LINKAGE SUPPORT SYSTEM

FIELD OF THE INVENTION

The present invention relates generally to linkages for movably attaching one structure to another and more particularly to a linkage support system for interconnecting first and second structures in a manner which allows deformation of the first structure while mitigating the transmission of resultant structural loads from the first structure to the second structure.

BACKGROUND OF THE INVENTION

In the prior art, it is known to mount one structure within another in a manner which accommodates bending of the outer structure without substantially transmitting structural loads caused by such bending to the inner structure. This may, for example, be accomplished by utilizing a spherical bearing to slidably mount one end of the inner structure to the outer structure and using a gimbal assembly to mount the other end of the inner structure to the outer structure. Thus, when the outer structure is bent, the gimbal assembly accommodates rotation of the inner structure about the center point of the gimbal assembly, while the spherical bearing accommodates both rotation and translation of the inner structure.

One example of an application for such a linkage system is the mounting of a large airborne radar antenna, such as those utilized in the AWACS and E2C surveillance aircraft. As those skilled in the art will appreciate, the radome of such an airborne radar antenna is subjected to large horizontal loads due to the heavy airflow impinging thereon during flight. Such airflow induced loads cause the radome support, i.e., its mechanical connection to the aircraft, to bend or deform transversely.

Although such bending of the radome support does not adversely affect operation of the radar system, since it only results in slight movement of the radome itself, it is desirable to prevent the transmission of structural loads, i.e., those due to wind induced transverse forces, from being transmitted from the radome support to the antenna support, which is contained within the radome support. As those skilled in the art will appreciate, any bending or deformation of the antenna support will result in highly undesirable movement of the radar antenna itself, which would, indeed, adversely affect the performance of the radar system. As such, it is essential that the transmission of structural loads from the radome support to the antenna support be minimized.

The above-described linkage systems have proven generally suitable for mounting large airborne radar antennas. However, as those skilled in the art will appreciate, such prior art gimbal assemblies are inherently volume and weight inefficient, thereby making them difficult to install and maintain. Furthermore, the inherent complexity of such gimbal systems reduces the reliability thereof.

As such, although the use of gimbal systems in the prior art to mitigate the transmission of structural loads has been generally satisfactory, it would be beneficial to provide a means for mitigating the transmission of structural loads which is substantially more volume efficient, so as to facilitate easier installation and maintenance thereof, and also so as to improve the reliability thereof. Further, it would be beneficial to provide such a means for mitigating the transmission of structural loads which is weight efficient. As will be appreciated by those skilled in the art, weight efficiency is of paramount importance in aerospace vehicles.

SUMMARY OF THE INVENTION

The present invention specifically addresses and alleviates the above-mentioned deficiencies associated with the prior art. More particularly, the present invention comprises a linkage support system for interconnecting first and second structures in a manner which allows bending or deformation of the first structure while mitigating the transmission of structural loads resulting from such bending or deformation to the second structure.

The linkage support system of the present invention comprises a first spherical bearing for slidably attaching a first portion of the first structure to a first portion of the second structure. Two link assemblies attach a second portion of the first structure to a second portion of the second structure. As described in detail below, the first portion of the first structure and the first portion of the second structure are at the lower ends thereof and the second portion of the first structure and the second portion of the second structure are at the upper ends thereof. However, such construction is by way of illustration only, and not by way of limitation.

Each of the two link assemblies comprises a link member extending generally from the first structure to the second structure, a pivot pin for attaching the link member to either the first structure or the second structure, and a second spherical bearing for attaching the link member to the other of the first structure and the second structure.

The first spherical bearing cooperates with the link assemblies to mitigate the transmission of structural loads from the first structure to the second structure when the first structure is bent or transversely deformed.

The first spherical bearing facilitates rotation of the second structure in two axes and facilitates translation of the second structure along one axis relative to the first structure. The two link assemblies are utilized and are disposed at diametrically opposed positions with respect to the second structure. The pivot pins and the second spherical bearings of the link assemblies are not disposed within a common horizontal plane. Therefore, bending of the first structure results in rotation of the link members about the pivot pins and also about the spherical bearings, thus accommodating deformation of the first structure.

According to the preferred embodiment of the present invention, the pivot pins attach the link members to the first structure and the spherical bearings attach the link members to the second structure. Alternatively, the spherical bearings attach the link members to the first structure and the pivot pins attach the link members to the second structure.

Thus, according to the present invention, a linkage support system for interconnecting first and second structures in the manner which allows deformation of the first structure while mitigating the transmission of resultant structural loads to the second structure is provided in a manner which is volume and weight efficient, so as to allow for easy installation and maintenance of the linkage support system and also so as to enhance the reliability thereof.

These, as well as other advantages of the present invention will be more apparent from the following description and drawings. It is understood that changes in the specific structure shown and described may be made within the scope of the claims without departing from the spirit and scope of the invention.

DETAILED DESCRIPTION OF THE PREFERRED EMBODIMENT

The detailed description set forth below in connection with the appended drawings is intended as a description of the presently preferred embodiment of the invention, and is not intended to represent the only form in which the present invention may be constructed or utilized. The description sets forth functions and the sequence of steps for constructing and operating the invention in connection with the illustrated embodiment. It is to be understood, however, that the same or equivalent functions may be accomplished by different embodiments that are also intended to be accomplished within the spirit and scope of the invention.

The linkage support system of the present invention is illustrated in FIGS. 8–14. FIGS. 1–7 illustrate a contemporary gimbal support system.

Figure 1:
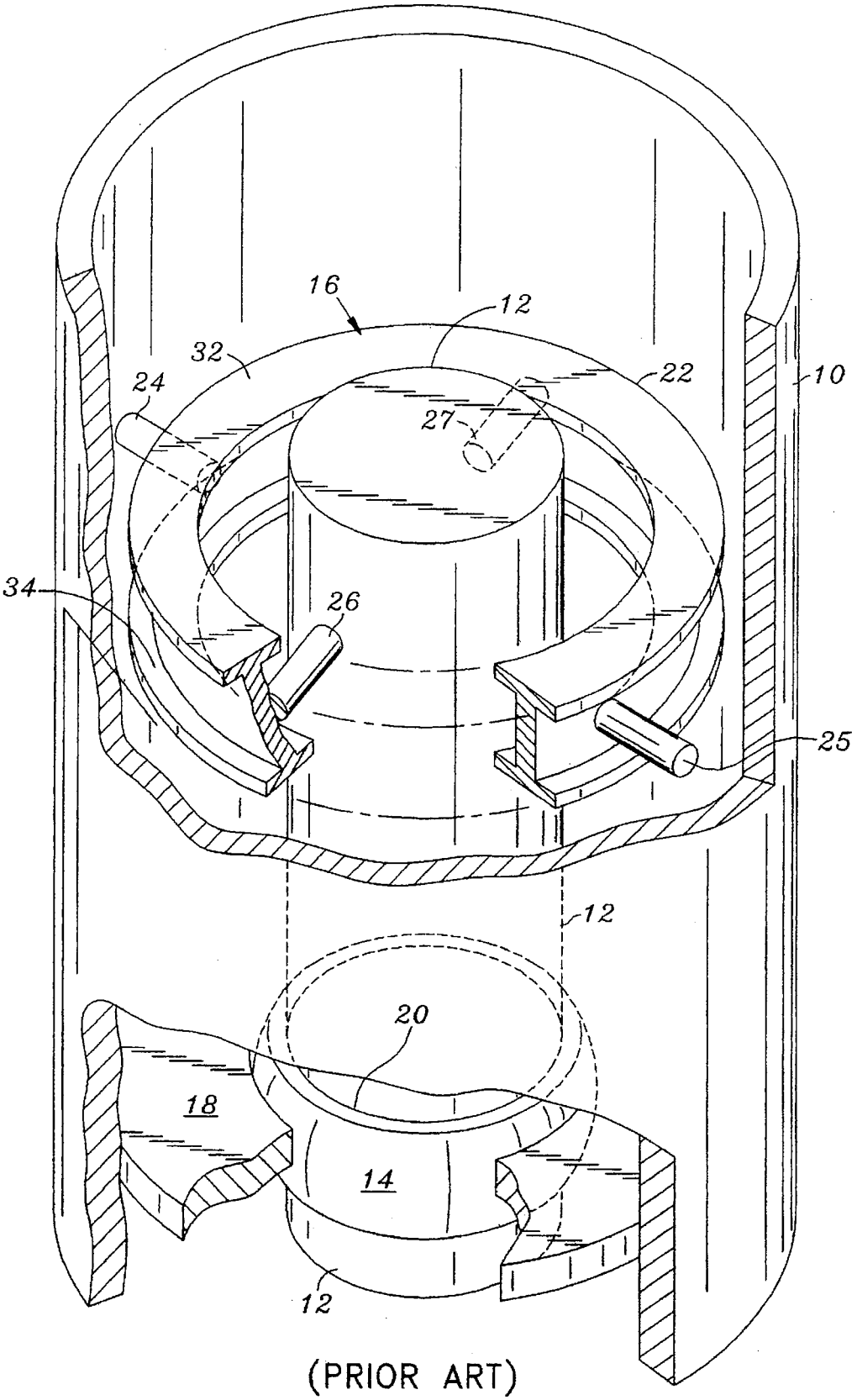
(PRIOR ART) FIG. 1
FIG. 1 is a cut-away perspective view showing the use of a spherical bearing and gimbal assembly for mitigating the transmission of structural loads from a first or outer structure to a second or inner structure during transverse deformation of the outer structure, according to the gimbal support system of the prior art.

Referring now to FIG. 1, according to contemporary practice a first or outer structure 10 has a second or inner structure 12 mounted therein via a spherical bearing 14 and a gimbal assembly 16, in a manner which mitigates the transmission of structural loads from the outer structure 10 to the inner structure 12 when the outer structure 10 is bent or transversely deformed. The spherical bearing 14 is mounted within an outer race 18 in a manner which facilitates rotation thereof about all three axes thereof. The spherical bearing receives the inner structure 12 within bore 20 thereof in a manner which facilities sliding or longitudinally translation of the inner structure 12 relative thereof.

The spherical bearing 14 thus allows the inner structure 12 to rotate in two axes about the center of the spherical bearing 14 and also to slide longitudinally with respect thereto. This is necessary to accommodate movement of the inner structure 12 which results from transverse deformation or bending of the outer structure 10.

The gimbal assembly 16 of the prior art allows the inner structure 12 to rotate in two perpendicular axes with respect to the outer structure 10. The gimbal assembly 16 comprises a gimbal ring 22 which is attached to the outer structure 10 via two pivot pins 24 and 25, for effecting rotation of the inner structure 12 about a first axis, and is connected to the inner structure 12 via two pivot pins 26 and 27 disposed orthogonally to the two pivot pins 24 and 25, for allowing the inner structure 12 to rotate about an axis 90 degrees from the rotation facilitated by pivot pins 24 and 25.

Figure 4:
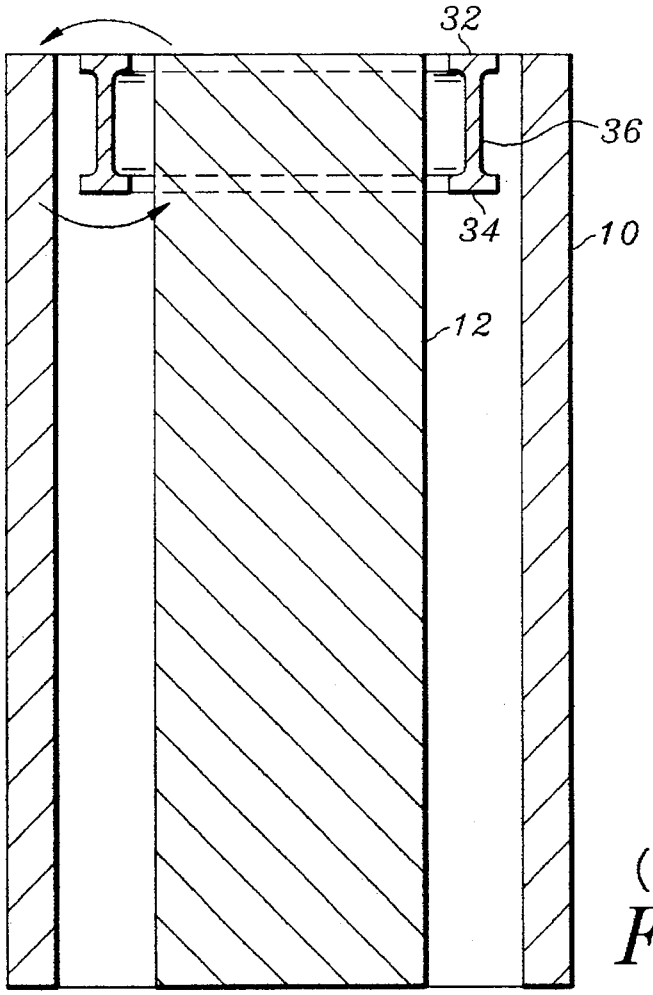
(PRIOR ART) FIG. 4
FIG. 4 is a cross-sectional side view of the prior art gimbal support system of FIG. 1 showing how a gimbal ring, which is inherently narrow in cross section, tends to be undesirably flexible, thus permitting undesirable deformations, i.e., rotation, bending, etc., thereof.

Thus, the spherical bearing 14 and the gimbal assembly 16 cooperate to isolate the inner structure 12 from structural loads when the outer structure 10 is deformed transversely. The gimbal ring 22 typically comprises a single ring having an I-configuration, as best shown in FIG. 4. Thus, the gimbal ring comprises an upper ring member 32, a lower ring member 34, and an interconnecting member 36.

Figure 2:
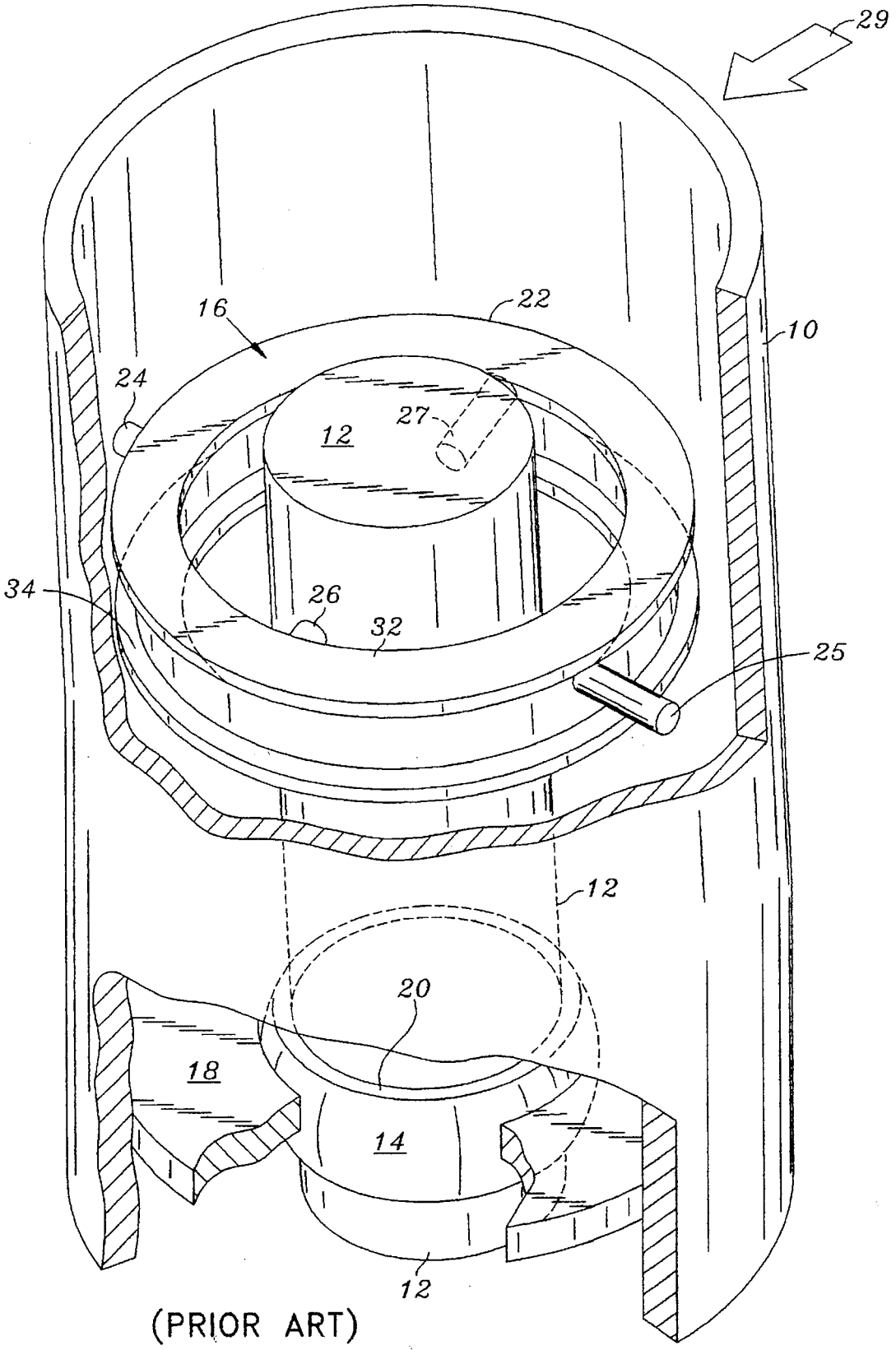
(PRIOR ART) FIG. 2
FIG. 2 shows the outer structure of FIG. 1 being transversely deformed or bent, and shows how the prior art spherical bearing and gimbal assembly mitigate the transmission of structural loads caused by such bending, from the outer structure to the inner structure.

Referring now to FIG. 2, when the outer structure 10 is subjected to a transverse force 29, such as would cause bending thereof, then the upper portion thereof is deformed transversely. The object of the spherical bearing 14 and gimbal assembly 16 is to mitigate the transmission of forces or structural loads from the outer structure 10 to the inner structure 12 which result from such transverse deformation.

When the outer structure 10 deforms transversely or bends, as shown, then the spherical bearing 14 rotates about its center, thus accommodating rotation of the inner structure 12 with respect to the outer structure 10. The spherical bearing 14 also accommodates generally vertical translation or sliding of the inner structure 12 with respect to the outer structure 10, as generally occurs during such bending of the outer structure 10.

During such bending of the outer structure 10, it is not uncommon for the gimbal ring 22 to deform, as discussed in detail below. Such deformation is possible due to the limited rigidity with which the gimbal ring 22 may be constructed in the limited volume provided between the inner structure 12 and the outer structure 10. The gimbal assembly 16 allows the upper end of the inner structure 12 to move, i.e., rotate, as a result of such rotation about the spherical bearing 14, without applying substantial structural loading thereto. Thus, as the inner structure 12 rotates about the center of the spherical bearing 14 and the upper end of the inner structure 12 moves about an arc as a result thereof, the gimbal assembly 16 facilitates rotation of the upper end of the inner structure 12 with respect to the upper end of the outer structure 10. In this manner, the inner structure 12 is substantially held in place with respect to the outer structure 10 without having substantial structural loads transmitted thereto due to transverse deformation of the outer structure 10.

Figure 3:
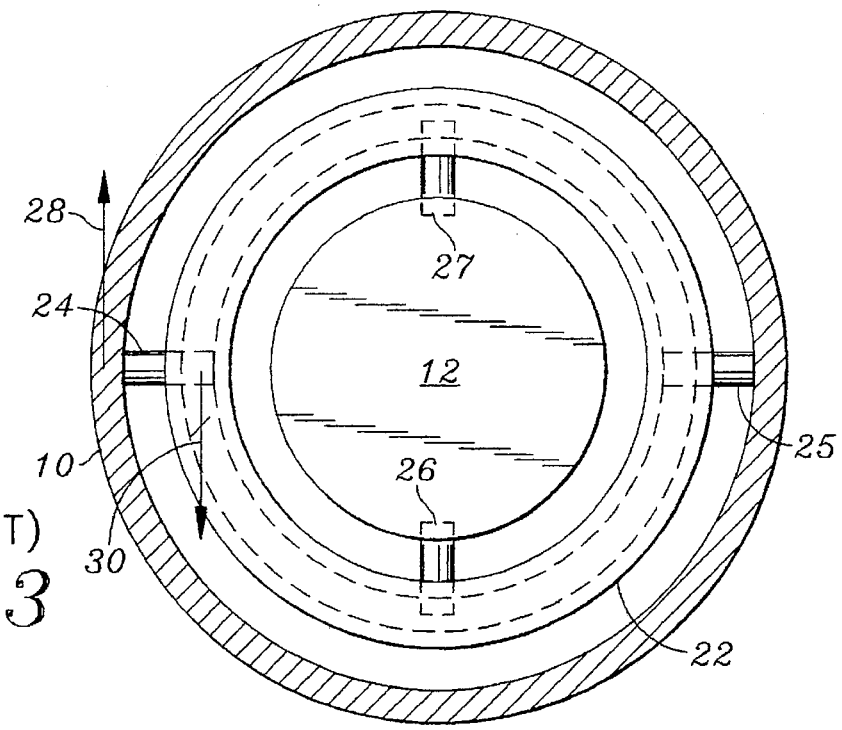
(PRIOR ART) FIG. 3
FIG. 3 is a top view, partially in cross section, of the prior art gimbal support system of FIG. 1, showing the gimbal pins in single shear, i.e., cantilevered.

Referring now to FIG. 3, each of the cantilevered pins 24–27 are mounted in single shear, i.e., cantilevered and in a manner which is both weight and space inefficient. As those skilled in the art will appreciate, acceleration of the outer structure 10 in the direction of arrow 28 causes a reactive force 30 on the gimbal ring 27 to be generated. This places the pivot pin 24 in shear. Since the pins 24–27 are not supported at both ends thereof, they are more prone to the effects of structural loading, i.e., bending for breakage, than they would be if placed in double shear, i.e., are supported at both ends thereof.

Referring now to FIG. 4, due to the limited volume between the outer structure 10 and the inner structure 12, the prior art combination of cantilevered pins 24–27 and a comparatively flexible gimbal ring 22 allows excessive relative motion between the outer structure 10 and the inner structure 12, as the gimbal ring 22 deforms undesirably. The gimbal ring 22 is inherently more flexible than desirable since its rigidity is constrained by the limited volume between the outer structure 10 and the inner structure 12.

Figure 5:
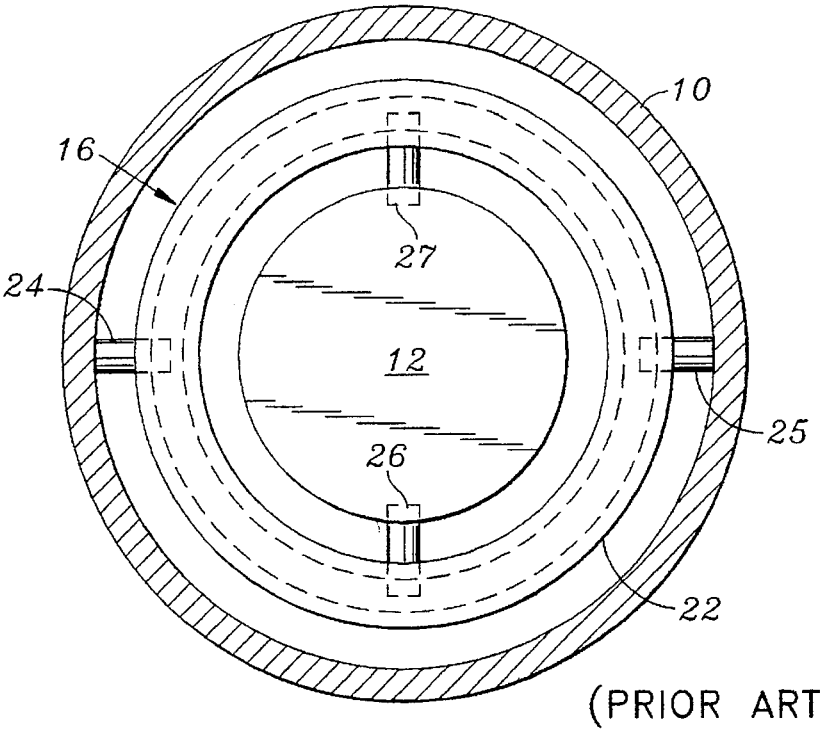
(PRIOR ART) FIG. 5
FIG. 5 is a top view of the prior art gimbal support system, partially in cross section, showing the limited volume between the outer and inner structures, within which the gimbal assembly is mounted.

Referring now to FIG. 5, the gimbal assembly 16 requires a comparatively large volume. As can be seen, the circumference or outer diameter of the gimbal ring 22 is almost equal to the inner diameter of the first structure 10 and the inner diameter of the gimbal ring 22 is almost equal to the outer diameter of the inner structure 12. Thus, as those skilled in the art will appreciate, the gimbal assembly 16 takes up an appreciable amount of available volume between the inner structure 12 and the outer structure 10.

Figure 6:
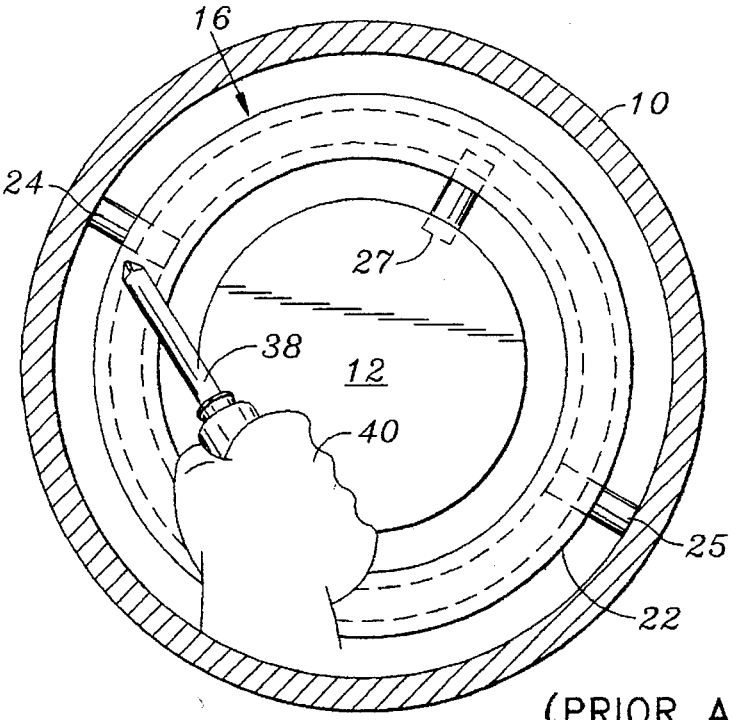
(PRIOR ART) FIG. 6
FIG. 6 is a top view of the prior art gimbal support system of FIG. 1, showing the difficulty of using tools to install and maintain the gimbal assembly thereof, due to the limited volume between the outer and inner structures thereof.

Referring now to FIG. 6, the volume inefficiency of the gimbal assembly 16 leaves little room for the manipulation of tools 38, particularly via an operator's hand 40. This makes assembly and maintenance of such a prior art gimbal assembly extremely difficult.

Figure 7:
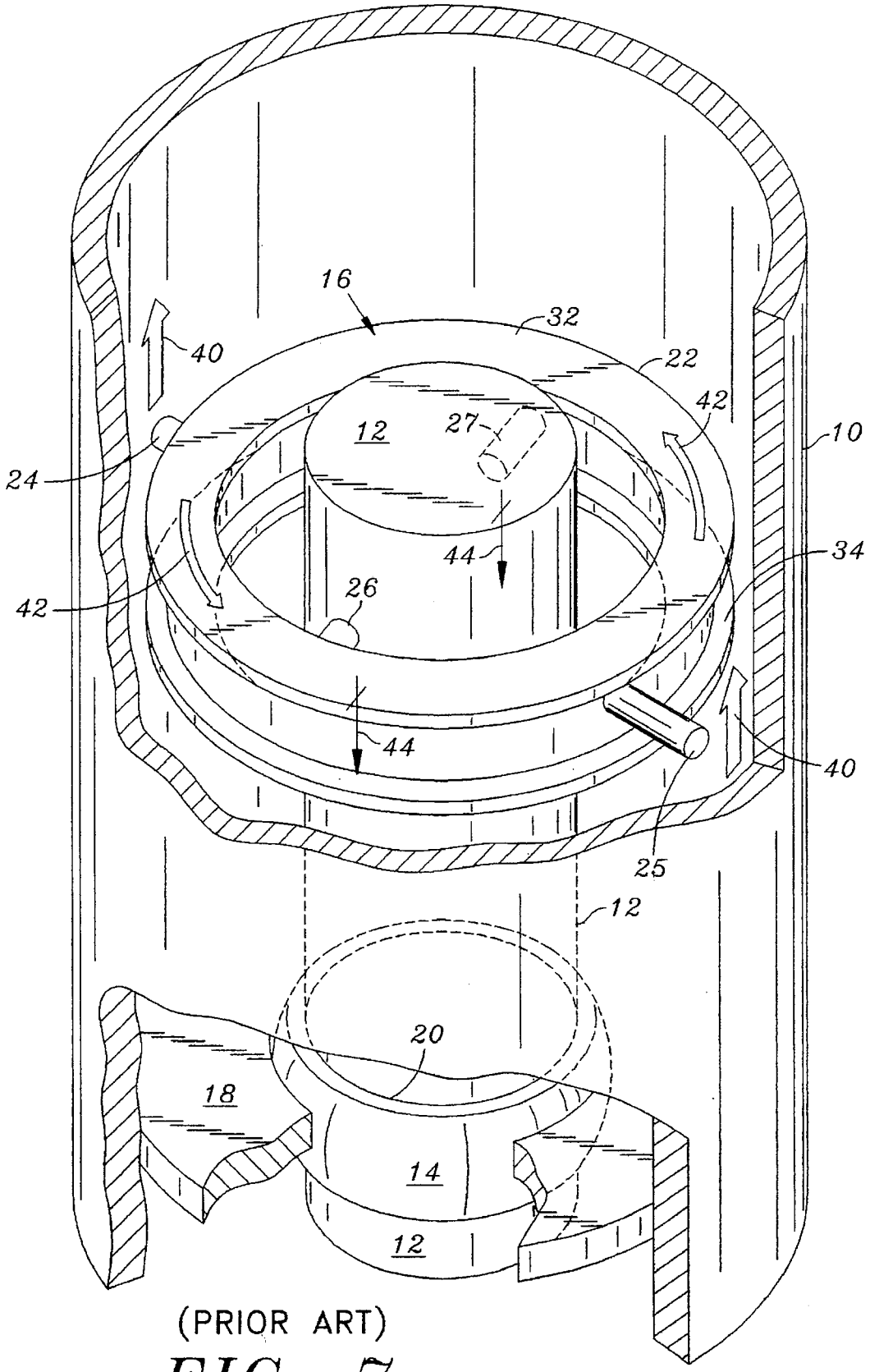
(PRIOR ART) FIG. 7
FIG. 7 is a perspective view of the prior art gimbal support system of FIG. 1, partially cut away to show the transmission of a longitudinal force from the outer structure to the inner structure thereof, so as to illustrate the potential for undesirable deformation of the gimbal ring thereof, during the application of such a force.

Referring now to FIG. 7, such prior art gimbal assemblies are comparatively flexible and thus do not transmit longitudinal loads, i.e., those in a vertical direction as illustrated by arrow 40, from the outer structure 10 to the inner structure 12 in a desirable manner. The gimbal ring 22 tends to bend and twist upon the application of such longitudinal loads. Such bending and twisting can undesirably affect the positioning of the inner structure 12.

For example, an upward movement, in the direction of arrow 40, of the outer structure 10 can result in a force 42 being transmitted through outer pins 24 and 25, along the gimbal ring 22, and then through inner pins 26 and 27 such that a reactive force 44 is generated in the inner structure 12.

Thus, as those skilled in the art will appreciate, the application of such an upward force 40 to the outer structure 10 may result in undesirable flexing or bending of the gimbal ring 22, thus reducing its effectiveness as a mount for the upper end of the inner structure 12.

One application of one such linkage system is in the mounting of a large airborne radar antennae such as those utilized in the AWACS and E2C surveillance aircraft, as discussed in detail above. The radome of such airborne radar antennae is subjected to large horizontal drag loads and vertical lift loads due to the airflow thereabout during flight. These loads cause the radome support to bend or deform transversely. Although bending of the radome support is generally acceptable, it is desirable to prevent the antenna support, contained therein, from experiencing structural loading due to such bending of the radome support. Thus, according to contemporary practice, a spherical bearing and gimbal mount assembly is frequently utilized to isolate the radar antenna mount from the radome mount in such aircraft.

Those skilled in the art will appreciate that various other uses for the linkage support system of the present invention likewise exist. Further, it is important to note that the second structure does not have to be contained within the first structure as shown and described. Rather, the two structures may be side by side, or in any other desirable relationship. Nor does the first structure have to be a single structure which is subject to bending. Rather, the first structure may alternatively comprise a plurality of separate structures, which may either be independent or connected to one another by various means, i.e., hinges, pivots, etc. Thus, the two independent structures may move with respect to one another, in a fashion which is generally analogous to the bending of a single structure.

Figure 8:
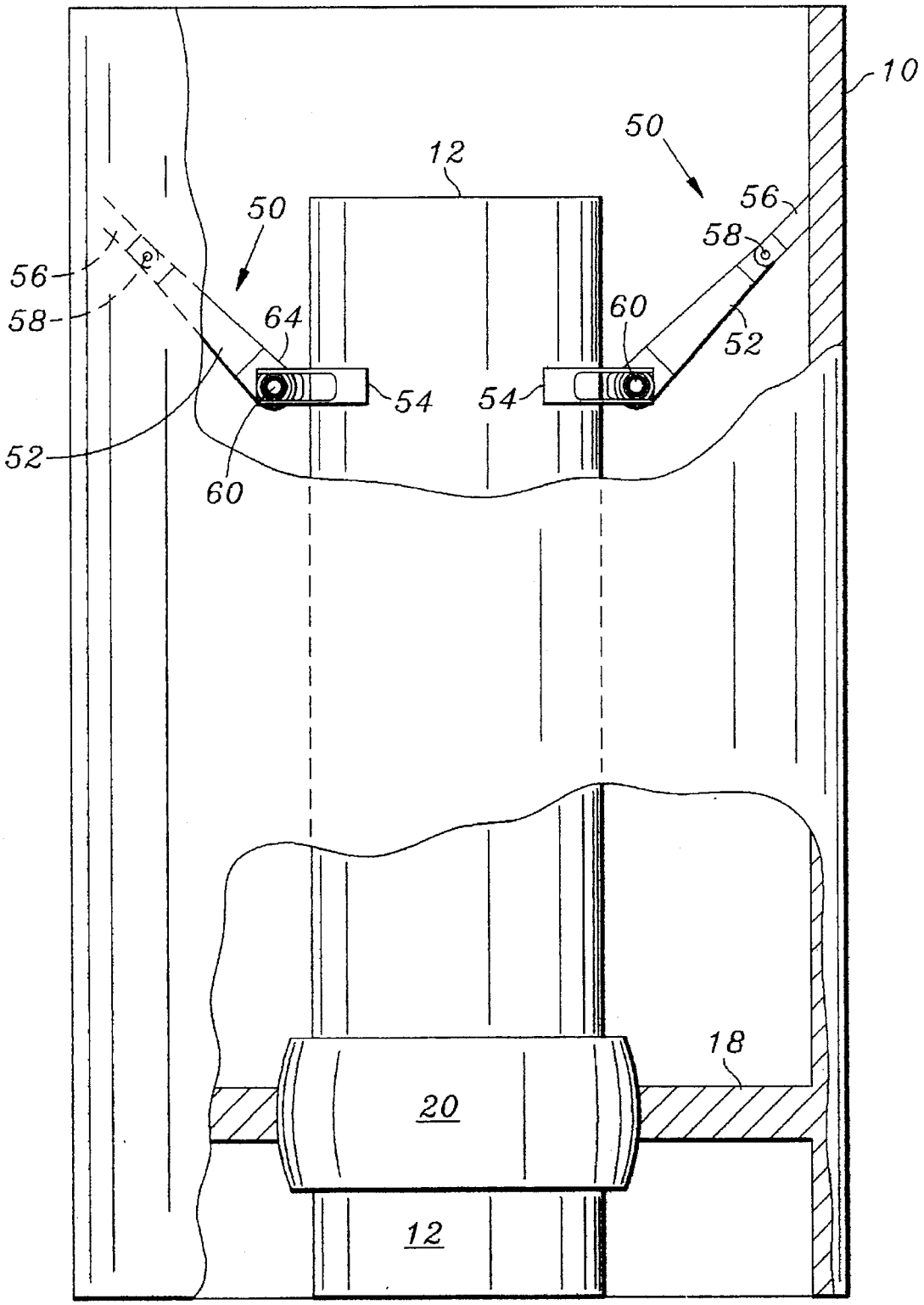
FIG. 8 is a side view of the linkage support system of the present invention, partially cut away to show the spherical bearing and links thereof.

Referring now to FIG. 8, according to the preferred embodiment of the present invention, the gimbal assembly 16 of the prior art is replaced with two diametrically opposed link assemblies 50. Each link member 50 is attached to the first structure 10 via a pivot pin 58. Each link member is attached to the inner structure 12 via a spherical bearing 62 (best shown in FIG. 10). Thus, each link member 52 has 1 degree of rotational freedom about pivot pin 58 with respect to the first structure 10, and the second structure 12 has 2 degrees of rotational freedom with respect to the each link member 52. The inside structure 12 does not have 3 degrees of rotational freedom with respect to each link member 52 since the inner structure 12 is restrained from moving in the third axis normally permitted by such spherical bearings by the other link member 50.

Figure 12:
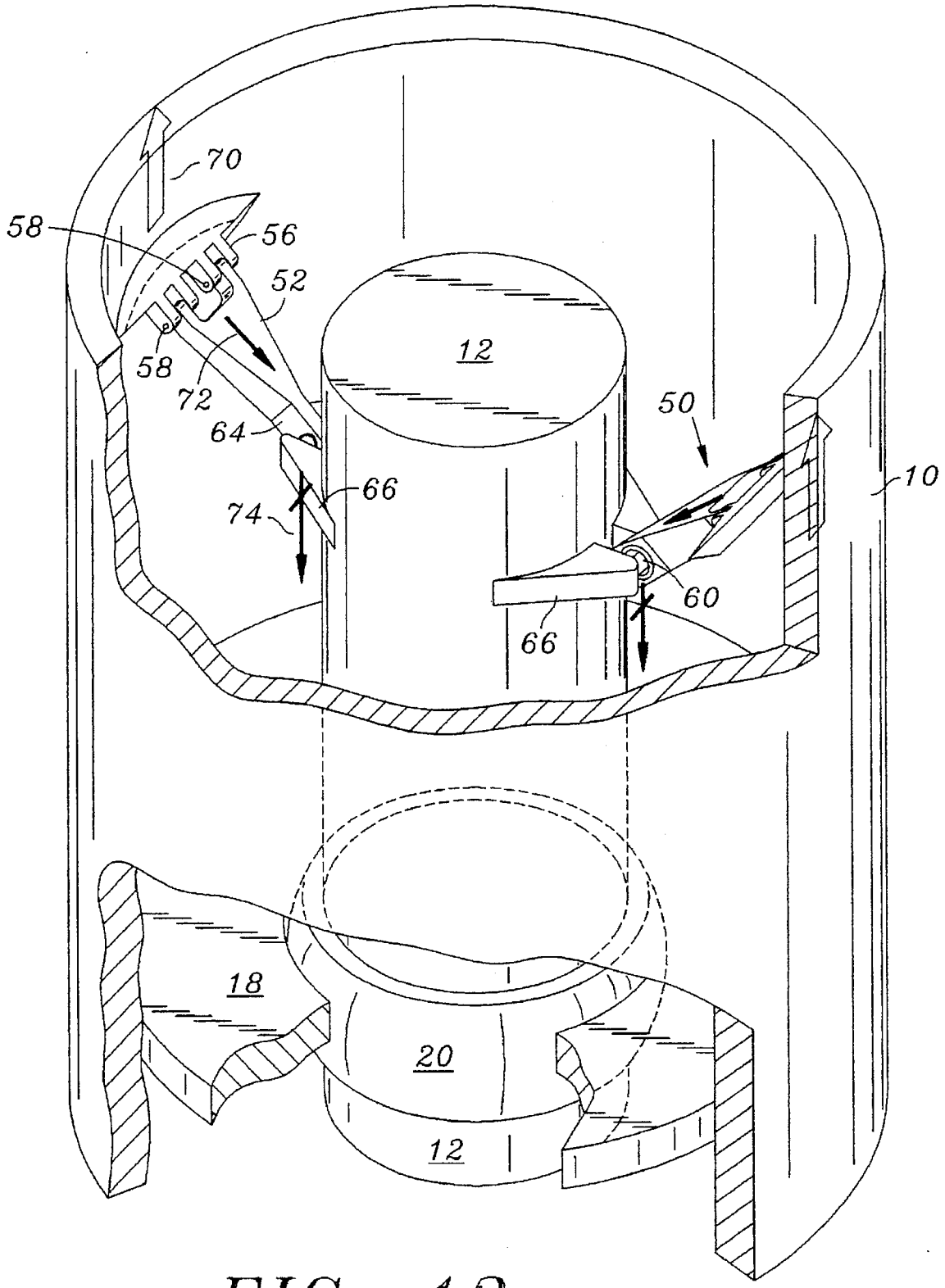
FIG. 12 is a perspective view of the linkage support system of the present invention, partially cut away to show the transmission of a longitudinal force from the outer structure to the inner structure thereof.

As best seen in FIG. 12, pivot pin 58 optionally comprises two separate pivot pins aligned along a common axis and passing through bracket 56 formed upon the first structure 10. The pivot pins 58 also pass through the upper end of link member 52, so as to facilitate rotation thereabout.

The spherical bearing 62 is rotatably disposed upon a pin 60 which mounts to bracket 54 of the second structure 12. Race 64 formed upon the lower end of link member 50 captures the spherical bearing 62 and facilitates rotation of the link member 52 thereabout.

Thus, according to the present invention, a means for mounting the inner structure 12 within the outer structure 10 in a manner which mitigates the transmission of structural loads from the outer structure 10 to the inner structure 12 is facilitated. The link assemblies 50 of the present invention are comparatively volume and weight efficient and thus provide ample room for assembly and maintenance thereof.

Figure 9:
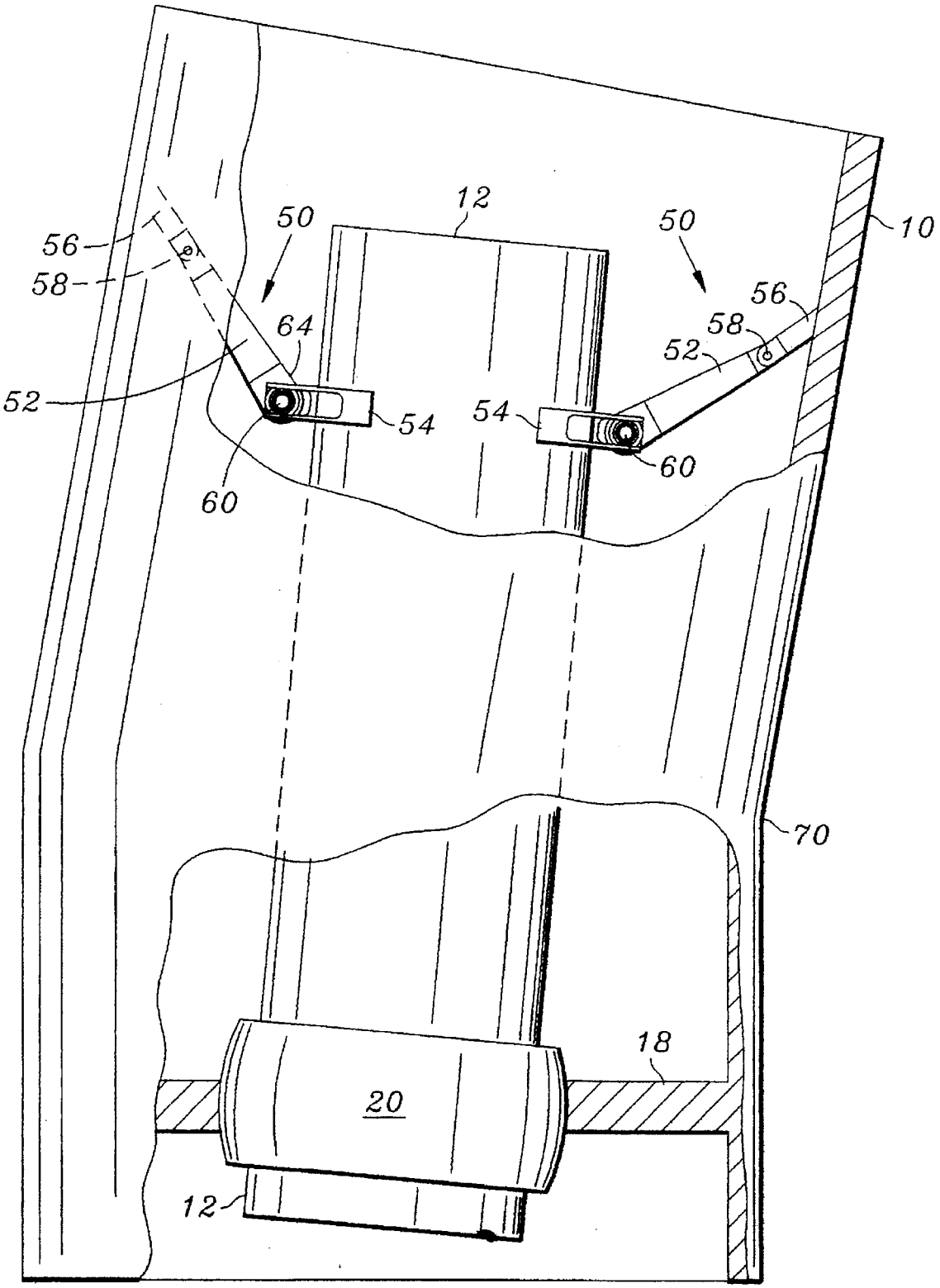
FIG. 9 is a side view of the linkage support system of FIG. 8, showing transverse deformation or bending of the outer structure thereof in the plane of the links and showing how the spherical bearing and links thereof move so as to mitigate the transmission of structural loads from the first structure to the second structure.

Referring now to FIG. 9, a bend 70 occurring in the outer structure 10 results in rotation of the inner structure 12 about the center of spherical bearing 20, thus causing the upper end of the inner structure 12 to move about an arc. Link assemblies 50 accommodate such motion of the upper end of the inner structure 12 without applying structural loads to the inner structure 12.

As will be appreciated by those skilled in the art, such bending of the outer structure 10 results in angular movement of the link members 52 about both the spherical bearings 62 and the pivot pins 58.

Figure 10:
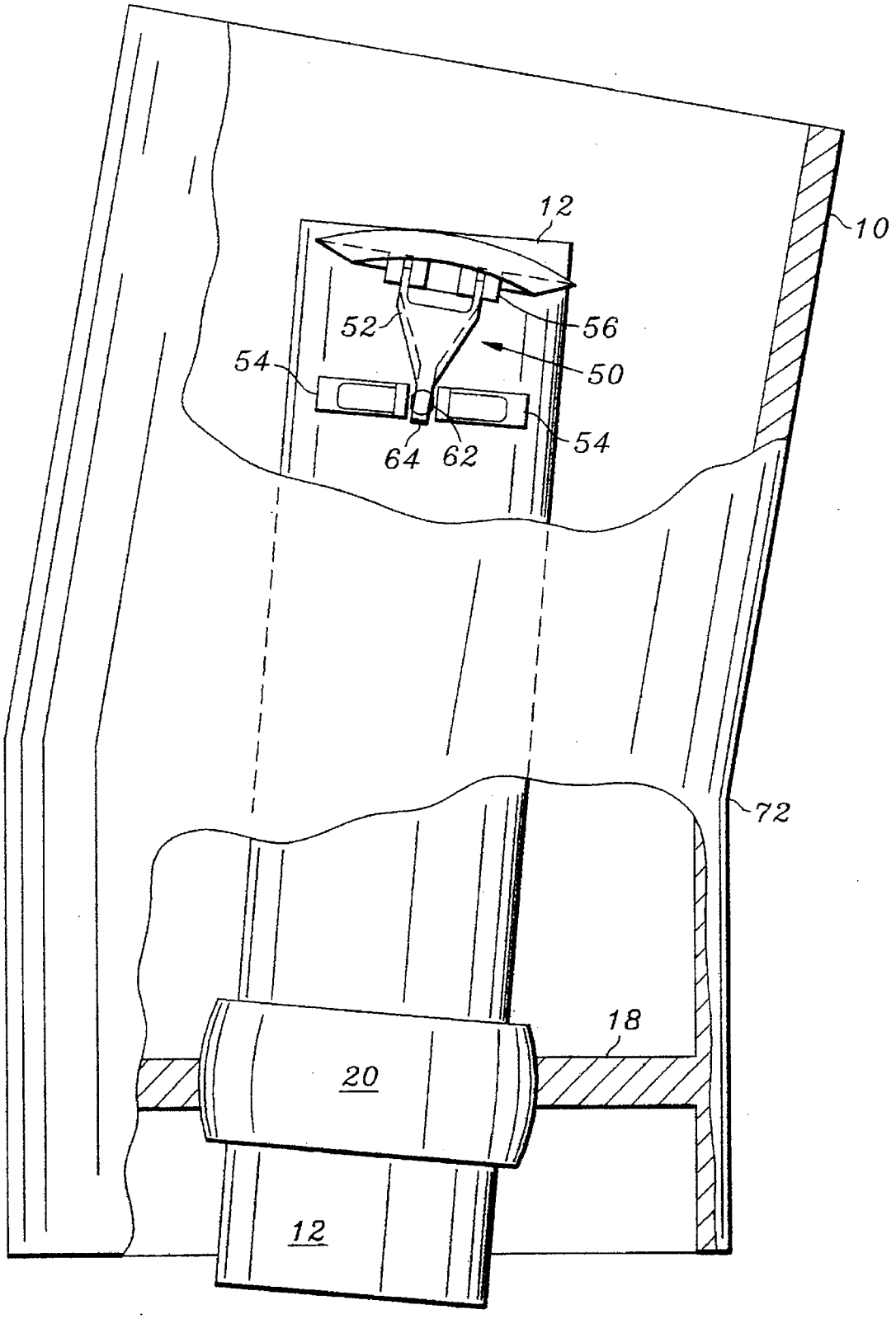
FIG. 10 is a side view of the linkage support system of FIG. 8, showing transverse deformation or bending of the outer structure thereof in a plane perpendicular to the plane of the links and showing how the spherical bearing and links thereof move so as to mitigate the transmission of structural loads from the first structure to the second structure.

Referring now to FIG. 10, forming a bend 72 in the outer member 10 at right angles to the bend illustrated in FIG. 9 results in little, if any rotation of the link members 52 about pivot pins 58. Instead, such bending is accommodated by rotation of the link members 52 about spherical bearings 62. Again, the transmission of structural loads to the inner structure 12 is mitigated.

Figure 11:
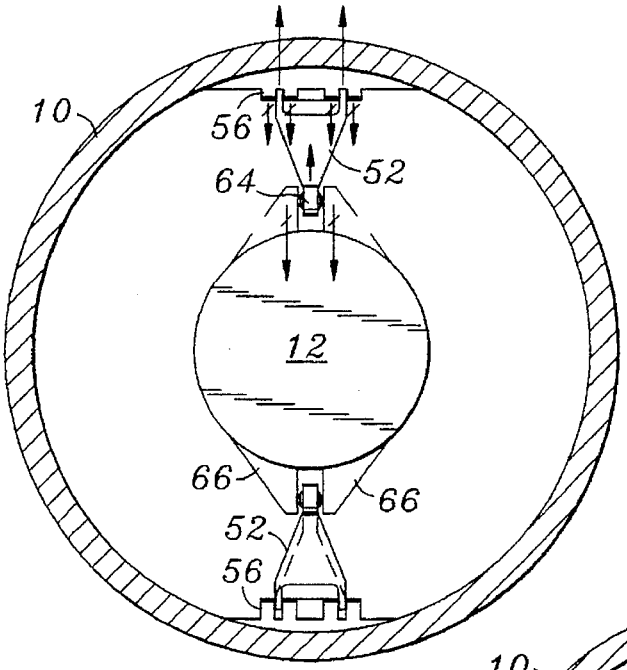
FIG. 11 is a top view of the linkage support system of the present invention, partially in cross section, showing how the present invention is weight and space efficient, thereby providing a greater volume between the outer and inner structures, so as to facilitate easier installation and maintenance thereof, and also showing a direct path for longitudinal loads transmitted from the outer structure to the inner structure.
Figure 13:
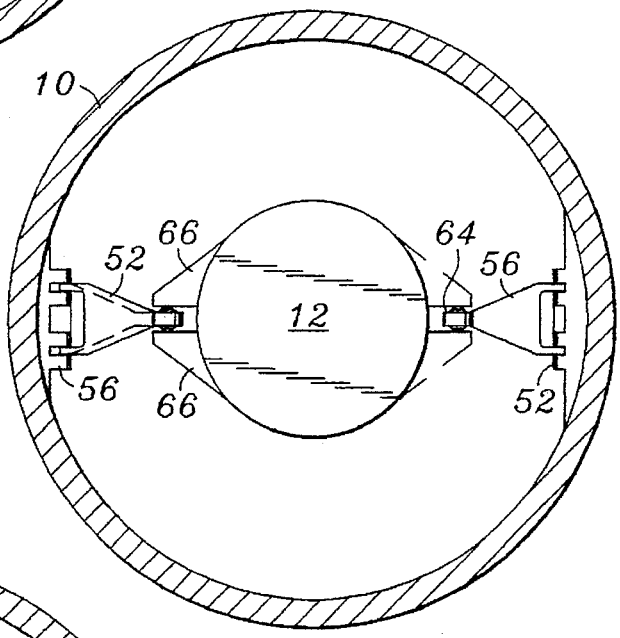
FIG. 13 is a top view, partially in cross section, of the linkage support system of the present invention, further showing the enhanced volume between the inner and outer structures thereof.

Referring now to FIGS. 11 and 13, the link support system of the present invention does not utilize cantilevered pins, as does the prior art gimbal assembly. All the pins of the present invention are in double shear, and are therefore weight and space efficient. The linkage support system of the present invention is substantially more stiff than that of the prior art gimbal support system. Further, a direct path is provided between the outer structure 10 and inner structure 12 for the transmission of desirable loads from the outer structure 10 to the inner structure 12. Thus, when the outer structure 10 moves vertically, structural loads are transmitted through pivot pins 68 and spherical bearing 62, so as to effect like vertical movement of the inner member 12.

Referring now to FIG. 12, longitudinal loads, i.e., those resulting from a vertical acceleration of the outer structure 10, are transmitted from the outer structure 10 to the inner structure 12 in a manner which does not result in deformation or bending of the mounting hardware, particularly the link members 52. As shown, a vertically upward acceleration indicated by arrow 70 results in a structural load being transmitted through link member 52 as indicated by arrow 72. This places the link member 52 primarily in tension, thereby resulting in no substantial deformation or bending thereof. The structural loading results in a reactive force as indicated by arrow 74 in the inner structure 12. In a similar manner, a downward acceleration of the outer structure 10 results in a compressive force being applied to the link members 52, again with no substantial deformation thereof. As those skilled in the art will appreciate, the link members 52 of the present invention are substantially more rigid than the corresponding gimbal ring 22 of the prior art. Thus, the link members 52 of the present invention result in more firm and stable mounting of the inner structure 12 with respect to the outer structure 10.

Figure 14:
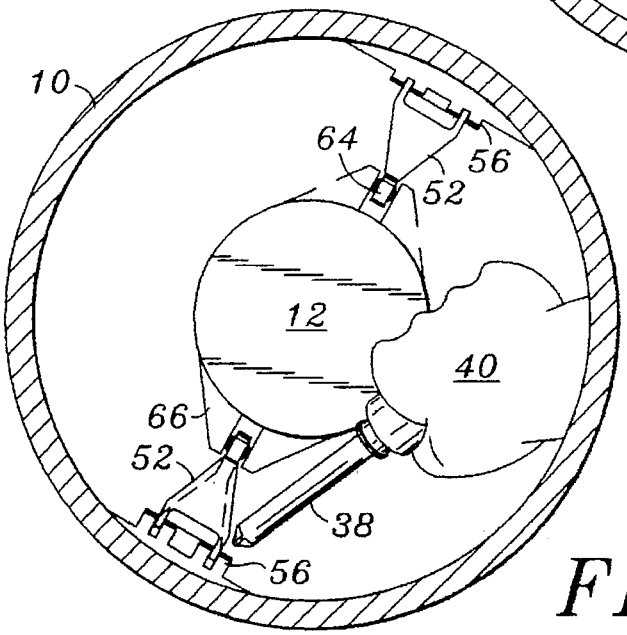
FIG. 14 is a top view, partially in cross section, of the linkage support system of the present invention, showing the ease with which tools may be manipulated within the volume between the inner and outer structures thereof, so as to facilitate installation and maintenance of the linkage support system.

Referring now to FIG. 14, it is clear that the link assemblies 50 of the present invention are volume efficient, and thereby leave ample room for an operator to insert a hand 40 and a tool 38, so as to effect assembly and/or maintenance of the linkage support system.

It is understood that the exemplary linkage support system described herein and shown in the drawings represents only a presently preferred embodiment of the invention. Indeed, various modifications and additions may be made to such embodiment without departing from the spirit and scope of the invention. For example, various different shapes and configurations of the inner and outer structures are contemplated. Indeed, the outer structure need not generally enclose the inner structure. The illustration and description of the present invention as comprising an outer structure which generally encloses an inner structure is thus by way of example only, and not by way of limitation. Those skilled in the art will appreciate that various other configurations of the interconnected structures are likewise suitable for the practice of the present invention. Thus, these and other modifications and additions may be obvious to those skilled in the art and may be implemented to adapt the present invention for use in a variety of different applications.

What is claimed is:

1. A linkage support system for interconnecting first and second structures in a manner which allows deformation of the first structure while mitigating transmission of structural loads resulting from such deformation to the second structure, said linkage support system comprising:

a) first spherical bearing attaching a first portion of the first structure to a first portion of the second structure;

b) at least two link assemblies attaching a second portion of the first structure to a second portion of the second structure, each of said link assemblies comprising:

i) a link member extending generally from the first structure to the second structure;

ii) a pivot pin for attaching said link member to one of said first structure and said second structure;

iii) a second spherical bearing for attaching said link member to the other of said first structure and said second structure; and c) wherein said first spherical bearing cooperates with said link assemblies to mitigate the transmission of structural loads to the second structure when the first structure is deformed.

2. The linkage support system as recited in claim 1 wherein said first spherical bearing facilitates rotation of said second structure in two axes and translation of the second structure along one axis, relative to the first structure.

3. The linkage support system as recited in claim 1 wherein said link assemblies are disposed at diametrically opposed positions with respect to said second structure.

4. The linkage support system as recited in claim 1 wherein the pivot pins and the second spherical bearings of said link assemblies are not disposed within a common transverse plane, such that bending of the first structure results in rotation of the link members about the pivot pins and spherical bearings.

5. The linkage support system as recited in claim 1 wherein said pivot pins attach said link members to the first structure and said spherical bearings attach said link members to the second structure.

6. The linkage support system as recited in claim 1 wherein one of the first and second structures comprises two separate, independently movable structures, wherein one of the two independent structures defines the first portion thereof and the other of the two independent structures defines the second portion thereof.

7. The linkage support system as recited in claim 1 one of the first and second structures comprises two interconnected structures which are movable with respect to one another, one of the two interconnected structures defining the first portion thereof and the other of the two interconnected structures defining the second portion thereof.

8. The linkage support system as recited in claim 1 wherein one of the first and second structures comprises first and second structures hingedly attached to one another such that the first independent structure defines the first portion and the second independent structure defines the second portion thereof.

9. A linkage support system for mounting a first structure within a second structure in a manner which allows transverse deformation of the first structure while mitigating transmission of structural loads resulting from such bending to the second structure, said linkage support system comprising:

a) a first spherical bearing attaching a first portion of the first structure to a first portion of the second structure, the spherical bearing facilitating rotation of the second structure in two axes and translation of the second structure along one axis, relative to the first structure;

b) two link assemblies attaching a second portion of the first structure to a second portion of the second structure, said two link assemblies disposed at diametrically opposed positions with respect to the second structure, each of said link assemblies comprising:

i) a link member extending generally from the first structure to the second structure;

ii) a pivot pin for attaching said link member to one of said first structure and said second structure;

iii) a second spherical bearing for attaching said link member to the other of said first structure and said second structure;

c) wherein the pivot pins and the second spherical bearings of said link assemblies are not disposed within a common transverse plane, such that bending of the first structure results in rotation of the link members about the pivot pins and spherical bearings; and d) wherein said first spherical bearing cooperates with said link assemblies to mitigate the transmission of structural loads to the second structure when the first structure is deformed transversely.

10. A method for interconnecting first and second structures in a manner which allows deformation of the first structure while mitigating transmission of structural loads resulting from such deformation to the second structure, the method comprising the steps of:

a) attaching a first portion of the first structure to a first portion of the second structure via a first spherical bearing;

b) attaching a second portion of the first structure to a second portion of the second structure via two link assemblies, each link assembly comprising:

i) a link member extending generally from the first structure to the second structure;

ii) a pivot pin for attaching said link member to one of said first structure and said second structure;

iii) a second spherical bearing for attaching said link member to the other of said first structure and said second structure; and c) wherein said first spherical bearing cooperates with said link assemblies to mitigate the transmission of structural loads to the second structure when the first structure is deformed.

11. The method as recited in claim 10 wherein said first spherical bearing facilitates rotation of said second structure in two axes and translation of the second structure along one axis, relative to the first structure.

12. The method as recited in claim 10, wherein said link assemblies are disposed at diametrically opposed positions with respect to said second structure.

13. The method as recited in claim 10, wherein the pivot pins and the second spherical bearings of said link assemblies are not disposed within a common plane, such that bending of the first structure results in rotation of the link members about the pivot pins and spherical bearings.

14. The method as recited in claim 10, wherein said pivot pins attach said link members to the first structure and said spherical bearings attach said link members to the second structure.

* * * * *